US006351624B1

(12) United States Patent
Hiruta

(10) Patent No.: US 6,351,624 B1
(45) Date of Patent: Feb. 26, 2002

(54) DOCUMENT HOLD-DOWN DEVICE AND METHOD FOR HOLDING DOWN DOCUMENT

(75) Inventor: Koichi Hiruta, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,798

(22) Filed: Jul. 28, 2000

(51) Int. Cl.[7] ..... G03G 15/00
(52) U.S. Cl. ..... 399/380; 355/75; 358/497
(58) Field of Search ..... 399/362, 377, 399/379, 380; 355/25, 75, 76; 358/497

(56) References Cited

U.S. PATENT DOCUMENTS 3,997,265 A * 12/1976 Menon et al. ..... 355/75
4,150,896 A * 4/1979 Wakeman ..... 355/75
5,812,285 A * 9/1998 Lin et al. ..... 358/497
6,233,426 B1 * 5/2001 Lee et al. ..... 399/380

FOREIGN PATENT DOCUMENTS

JP 4-268546 9/1992

* cited by examiner

*Primary Examiner*—Sophia S. Chen
(74) *Attorney, Agent, or Firm*—Foley & Lardner

(57) ABSTRACT

The document pressing device according to the present invention includes a document table which is mounted on a main body and supports a document, a document cover which covers the document table and presses the document against the document table, an adjusting hinge which supports an opening and closing fulcrum of the document cover and is slidable in the thickness direction of the document according to the thickness of the document supported on the document table, a holding member which can hold an opening and closing side of the document cover and slides in the thickness direction of the document in synchronization with the sliding movement of the adjusting hinge, a hook which is fitted to an opening and closing side of the document cover and engages with the holding member to give the document cover a pressing force to press the document against the document table, and a release member for releasing the engagement of the hook from the holding member.

16 Claims, 3 Drawing Sheets

DOCUMENT HOLD-DOWN DEVICE AND METHOD FOR HOLDING DOWN DOCUMENT

BACKGROUND OF THE INVENTION

1. Field of the Invention

The present invention relates to a document pressing device which stably presses a particularly thick document against a document table and a document pressing method.

2. Description of the Related Art

When a conventional electrophotographic copying machine, printer or the like reads a thick document supported by a document table, to prevent defective reading due to leakage of light or a displacement of the document, the document is pressed from above a document cover by an operator to prevent the document from becoming loose or a hinge which is an opening and closing fulcrum of the document cover is vertically moved according to a thickness of the document and an opening and closing side of the document cover is also engaged with a pressure-applying member of a main body to hold the document cover horizontal to press the document as disclosed in Japanese Patent Application Laid-Open No. 4-268546.

Between the aforesaid document pressing methods, however, the former case is very poor in operability because the operator must keep pressing the document cover while an image is being read. The latter case does not require the operator to keep pressing the document cover and its operability is improved. But, the operation to fix the document cover took time because the opening and closing end of the document cover must be fixed to a pressure-applying member while adjusting a height of the opening and closing side of the document cover in order to fix the document cover horizontal to press the thick document.

Therefore, it is desired to improve operability of the document cover by facilitating and simplifying its fixing operation to securely press the document against the document table and to prevent the document from being displaced or exposure light from leaking at the time of reading even when the document placed on the document table is thick.

SUMMARY OF THE INVENTION

It is an object of the present invention to obtain a good reading image while preventing a displacement of a document or leakage of exposure light when a document having a large thickness is placed on a document table and read.

It is another object of the present invention to obtain high operability by facilitating and simplifying the fixing operation to hold the document cover horizontal in order to securely press the thick document to the document table by the document cover.

According to the present invention, it provides a document pressing device, comprising document supporting means mounted on a main body for supporting a document; document covering means for covering the document supporting means and pressing the document against the document supporting means; adjusting means for supporting an opening/closing fulcrum of the document covering means and being slidable in a thickness direction of the document according to the thickness of the document supported by the document supporting means; holding means which can hold an opening and closing side of the document covering means for sliding in the thickness direction of the document in synchronization with the sliding movement of the adjusting means; engaging means disposed on the opening and closing side of the document covering means for engaging with the holding means to give the document covering means a pressing force for pressing the document against the document supporting means; and engagement releasing means for releasing the engagement of the engaging means from the holding means.

The present invention also provides a document pressing device, comprising a document table disposed on a main body to support a document; a document cover which covers the document table to press the document against the document table; an adjusting hinge configured to support an opening/closing fulcrum of the document cover and being slidable in a thickness direction of the document according to the thickness of the document supported by the document table; a holding member which can hold an opening and closing side of the document cover to slide in the thickness direction of the document in synchronization with the sliding movement of the adjusting hinge; a hook disposed on the opening and closing side of the document cover to engage with the holding member to give the document cover a pressing force to press the document against the document table; and a release member to release the engagement of the hook from the holding member.

Besides, the present invention provides a document pressing method for pressing a document against a document table by covering the document placed on the document table mounted on a main body by a document cover, comprising the steps of an adjusting step to slide an opening and closing fulcrum of the document cover in the thickness direction of the document according to a thickness of the document supported by the document table and slide a holding member for holding an opening and closing side of the document cover in the thickness direction of the document in synchronization with the sliding movement of the opening and closing fulcrum; an engaging step to engage a hook fitted to the document cover with the holding member to press the document against the document table by the document cover; and a releasing step to release the engagement of the hook from the holding member.

DETAILED DESCRIPTION OF THE PREFERRED EMBODIMENTS

Referring to the attached drawings, preferred embodiments of the present invention are described in details.

Figure 1:
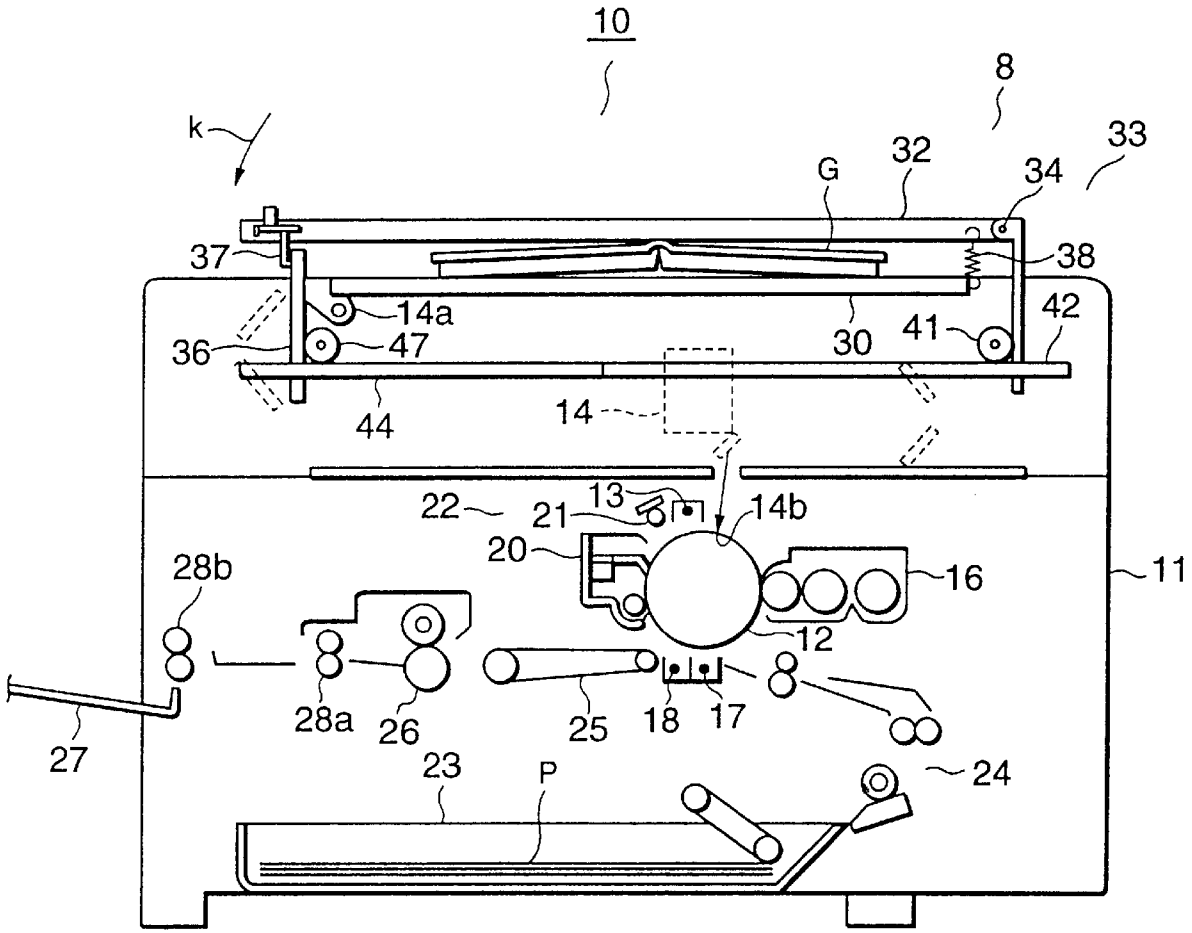
FIG. 1 is a schematic structural block diagram of the main portions of an image forming device to which the document pressing device embodying the present.
Figure 2:
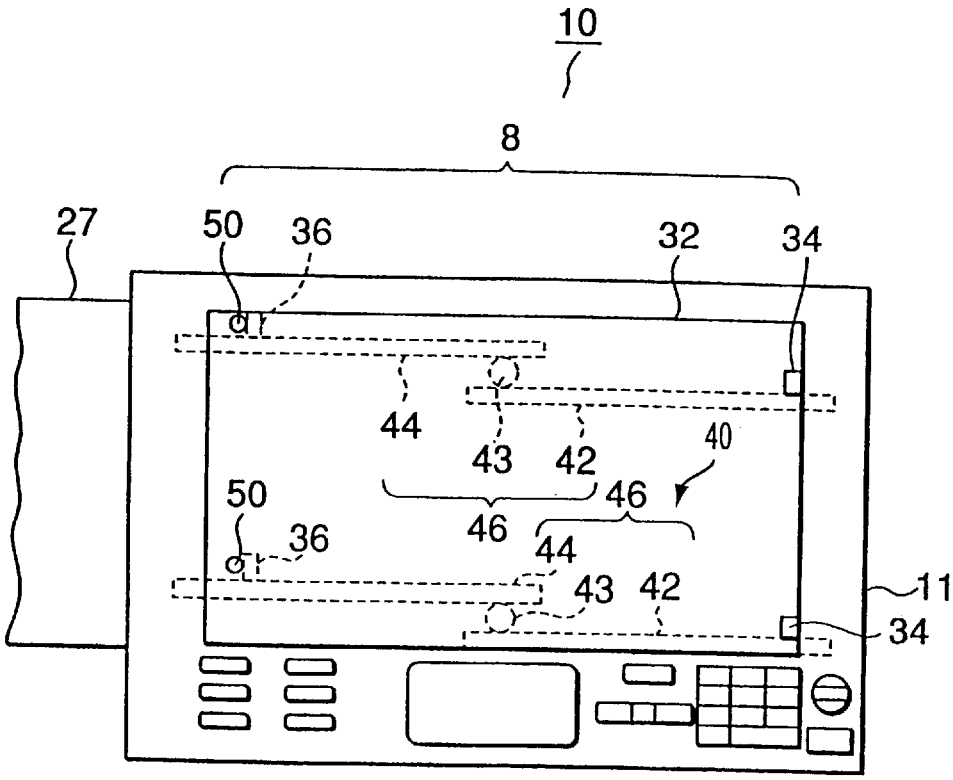
FIG. 2 is a schematic plan view of the image forming device to which the document pressing device embodying the present invention.
Figure 3:
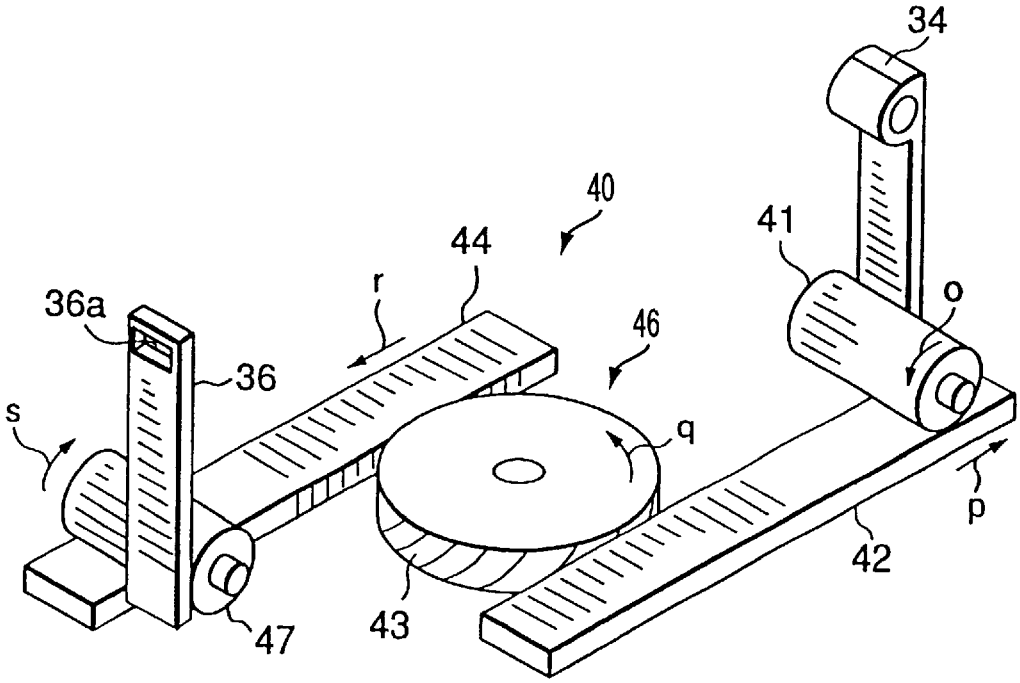
FIG. 3 is a schematic perspective diagram view of the pressing device embodying the present invention.

FIG. 1 is a structural diagram illustrating the main portions of a document pressing device 8 embodying the present invention which is applied to an image forming device 10 such as a copying machine. The image forming device 10 has within a main body 11 an image forming means 22 around a photosensitive drum 12, the image forming means 22 comprising a main charger 13 mounted along a rotating direction of the photosensitive drum 12, an exposure unit 14*b* to which reflected light is irradiated from a light source 14*a* by an exposure device 14 which is a document reader unit, a developing device 16, a transferring device 17, a peeling device 18, a cleaner 20, and a charge remover 21. A paper supply means 24 which takes out a paper P from a paper supply cassette device 23 and supplies it to the position of the transferring device 17, a fixing roller 26 which fixes a toner image on the paper P conveyed by a transferring belt 25, a conveying roller 28*a* which guides the paper P to a receiving tray 27 and an exit roller 28*b* are disposed below the image forming means 22.

A document table 30 and the document pressing device 8, which presses a document G so that a reading surface of the document G placed on the document table 30 is press-contacted to the document table 30, are disposed on the top portion of the main body 11.

Then, the document pressing device 8 is described in details. The document pressing device 8 has a document cover 32 for firmly pressing the document G placed on the document table 30 and a pressing device 33 for pressing the document cover 32 in a direction of the thickness of the document G. The pressing device 33 is disposed at front and rear portions of the main body 11 so to press uniformly the document G by the entire surface of the document cover 32.

The pressing device 33 has the document cover 32 openably supported relative to the document table 30 with an adjusting hinge 34 as an opening and closing fulcrum, and a pawl 37*d* of a hook 37, which is attached to the opening and closing side of the document cover, engaged with a through hole 36*a* of a slide plate 36 which is a holding member. The adjusting hinge 34 is vertically slidable along a guide (not shown) of the main body 11 depending on a thickness of the document G placed on the document table 30. An adjusting spring 38 is fitted between the main body 11 and the document cover 32 to keep pulling the document cover 32 downward against the thickness of the document G.

Sliding movement of the adjusting hinge 34 is transferred to the slide plate 36 by a transferring device 40, the slide plate 36 is synchronized with the slide movement of the adjusting hinge 34 so to vertically slide along a guide (not shown).

The transferring device 40 has a first gear 41 which is a first converting means to change the sliding movement of the adjusting hinge 34 into rotation movement, a linkage device 46 consisting of a first rack 42, a second gear 43 and a second rack 44, and a third gear 47 which is a second converting means for converting the rotation movement from the linkage device 46 into sliding movement of the slide plate 36.

Figure 4:
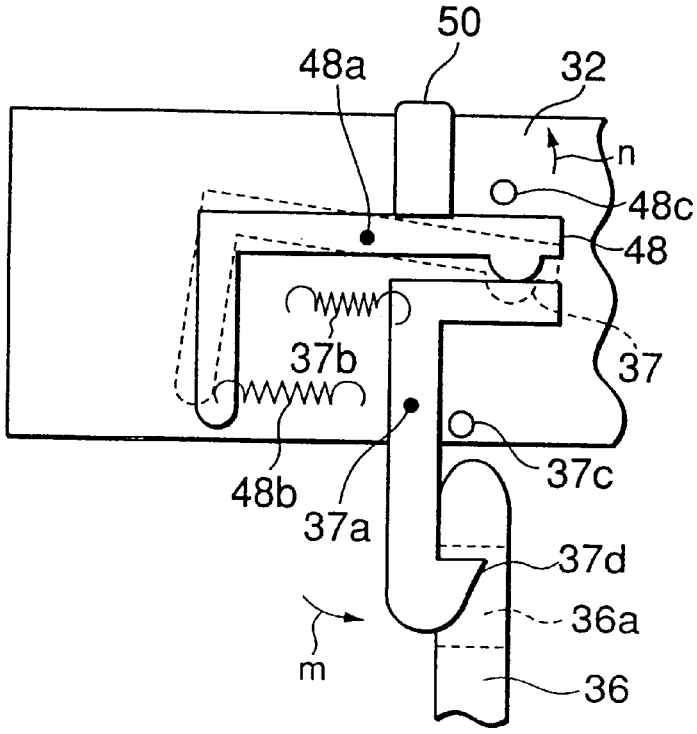
FIG. 4 is a schematic structural block diagram of a hook and a release lever embodying the present invention.

The hook 37 attached to the document cover 32 is pivotable about a fulcrum 37*a*, always pulled in a direction of arrow m by a first spring 37*b* and limited its pivoting by a first pin 37*c*. Reference numeral 48 denotes a release lever for releasing the hook 37 from the slide plate 36. The release lever 48 is pivotable about a fulcrum 48*a*, always pulled in a direction of an arrow n and limited its pivoting by a second pin 48*c*. The release lever 48 is pivoted in the direction opposite to the direction of the arrow n when a release button 50 is pushed to release the hook 37 from the slide plate 36. The release button 50 is normally locked in a release position by a lock mechanism (not shown). When the release button 50 is in the release position, the release lever 48 is held in the release position indicated by a dotted line in FIG. 4. When it is in a locked state and the release button 50 is pressed, the lock mechanism is released, and the release lever 48 is set to the hookable position indicated by a solid line in FIG. 4.

Where a document, which is a sheet of paper, is placed on the document table 30, the adjusting hinge 34 is not slid in a vertical direction. Therefore, the document cover 32 is press-contacted to fix the document to the document table 30 so to bring into intimate contact with the document table 30 on the main body 11, and a copying operation is performed by the image forming means 22. Because the release button 50 is locked and the hook 37 is free from the slide plate 36 at this time, the document can be removed by simply releasing the document cover 32 after the copying is completed.

In a case that a book type or stapled thick document G is placed on the document table 30, the document G is placed on the document table 30 and the document cover 32 is closed in a direction of arrow k, then the adjusting hinge 34 is raised against the pulling force of the adjusting spring 38 depending on a thickness of the document G. With the upward movement of the adjusting hinge 34, the first gear 41, the first rack 42, the second gear 43, the second rack 44 and the third gear 47 are respectively operated in directions of arrows o, p, q, r and s to raise the slide plate 36.

Where the thick document G is placed on the document table 30, the release button 50 is previously pushed to unlock the lock mechanism. Thus, the release lever 48 is pulled by the second spring 48*b* to pivot in the direction of the arrow n so to come into contact with the second pin 48*c*. Therefore, when the document cover 32 is closed, the hook 37 is pivoted in the direction indicated by the arrow m by means of the first sprint 37*b* so to engage the pawl 37*d* with the through hole 36*a* of the slide plate 36 which is raised in synchronization with the adjusting hinge 34. As a result, the document cover 32 is held horizontal and also pulled toward the document table 30 by the adjusting spring 38, so that the document G is uniformly pressed against the document table 30.

After completing the copying operation by the image forming means 22, the release button 50 is pushed to fix in the lock position, and the release lever 48 is pivoted in the direction opposite to the direction of the arrow n against the second spring 48*b* so to be fixed in the release position. The hook 37 is pivoted in the direction opposite to the direction of the arrow m against the first spring 37*b* to release the engagement of the pawl 37*d* with the through hole 36*a*, and the document cover 32 is opened to remove the document G. When the document cover 32 is opened, the adjusting hinge 34 is lowered by being pulled by the adjusting spring 38, and the slide plate 36 is also lowered through the first gear 41, the first rack 42, the second gear 43, the second rack 44 and the third gear 47.

Thus, for copying the thick document G such as a book type, the slide plate 36 is raised in synchronization with the upward movement of the adjusting hinge 34 according to the thickness of the document G, and the hook 37 is engaged with the raised slide plate 36, so that the document G is firmly pressed against the document table 30 by the document cover 32 which is held horizontal. Besides, the engaging and disengaging operations of the hook 37 with and from the slide plate 36 can be made very easily by the opening and closing operation of the document cover 32 and an on/off operation of the release button 50.

Therefore, a conventional operation by an operator to press the document cover by hands or complex operation to fix the opening/closing end portion of the document cover to a holding member becomes unnecessary. And, the thick document G can be pressed against the document table 30 quite easily and securely, so that a copy error due to a displacement of the document or leakage of light at copying can be prevented, and a good image can be obtained.

Figure 5:
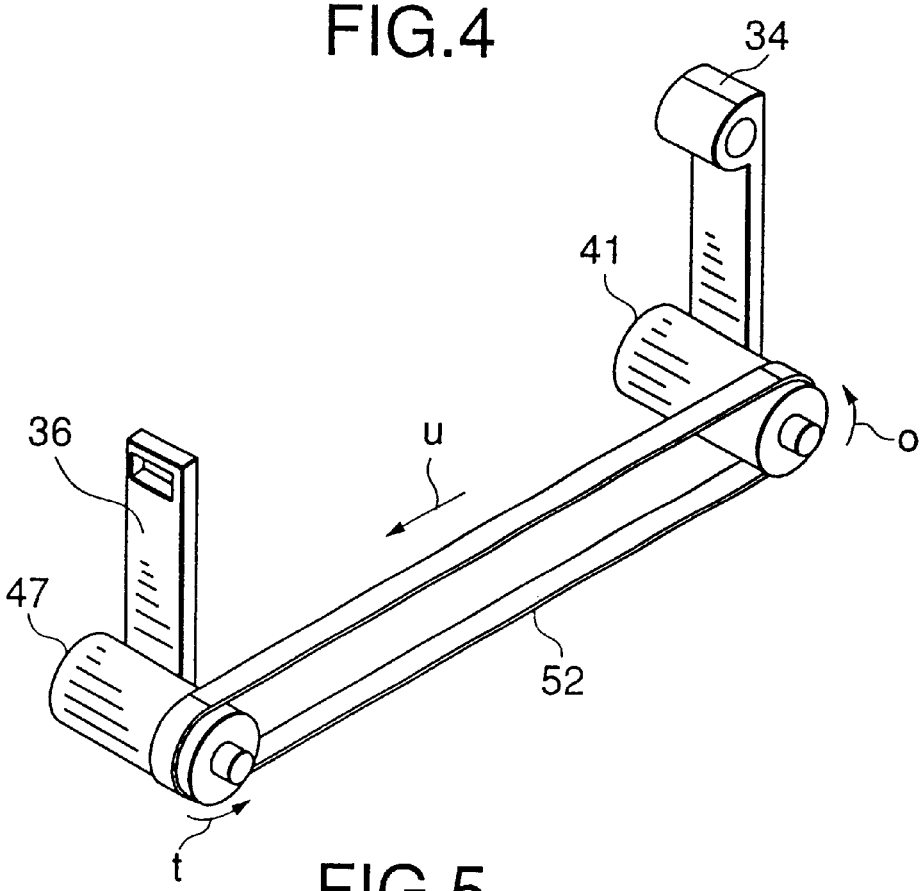
FIG. 5 is a schematic perspective diagram view of a timing belt according to a modified embodiment of the present invention.

The present invention is not limited to the aforesaid embodiment and can be modified in various ways without departing from the invention. For example, the mechanism to vertically move the slide plate in synchronization with the adjusting hinge in the aforesaid embodiment is quite arbitrary, and the slide movement of the adjusting hinge 34 may be transferred to the slide plate 36 by means of a timing belt 52 as indicated by a modification shown in FIG. 5.

Specifically, according to this modification, the timing belt 52 is put around the first gear 41 and the third gear 47 of the aforesaid embodiment so to rotate the timing belt 52 in the direction of an arrow u according to the rotation of the first gear 41 in the direction of the arrow o when the adjusting hinge 34 is raised. Then, the slide plate 36 is moved upward in synchronization with the adjusting hinge 34 by rotating the third gear 47 in the direction of an arrow t. And, the hook 37 is engaged with the raised slide plate 36 to hold the document cover 32 horizontal. Thus, the document G is pressed against the document table 30.

In this modification, the thick document G can be pressed firmly against the document table 30 by a simple operation in the same way as in the aforesaid embodiment, and a good image can be obtained without occurrence of a displacement of the document or leakage of light at copying.

Furthermore, the mechanism to vertically move the slide plate 36 in synchronization with the adjusting hinge 34 in the aforesaid embodiment may be designed to detect a rotated amount of the first gear 41 which is rotated according to the sliding movement of the adjusting hinge 34 and to rotate the third gear 47 for vertically moving the slide plate 36 by means of a stepping motor according to the detected rotated amount.

And, the structure of the releasing means for releasing the engagement between the hook and the slide plate is also arbitrary. Besides, the document covering device is not limited to the document cover and may be provided with an automatic document feeding device as desired.

As described above in detail, when the document covering means is opened or closed according to the present invention, the thick document can be pressed firmly against the document supporting means easily and securely, and a good read image can be obtained without occurrence of a copy error due to displacement of the image or leakage of light. In addition, the thick document can be fixed quite easily by a single operation of the releasing means when the document is set in position or removed, and its operability can be improved.

What is claimed is:

1. A document pressing device, comprising:

document supporting means mounted on a main body for supporting a document;

document covering means for covering the document supporting means and pressing the document against the document supporting means;

adjusting means for supporting an opening/closing fulcrum of the document covering means and being slidable in a thickness direction of the document according to the thickness of the document supported by the document supporting means;

holding means which can hold an opening and closing side of the document covering means for sliding in the thickness direction of the document in synchronization with the sliding movement of the adjusting means;

engaging means disposed on the opening and closing side of the document covering means for engaging with the holding means to give the document covering means a pressing force for pressing the document against the document supporting means; and engagement releasing means for releasing the engagement of the engaging means from the holding means.

2. A document pressing device as claimed in claim 1, wherein the holding means slides in the thickness direction of the document on the side opposed to the side where the adjusting means is disposed in the vicinity of the document supporting means, and the engaging means is engaged with the holding means on the side opposite to the side of the document covering means supported by the adjusting means.

3. A document pressing device as claimed in claim 1, wherein the adjusting means supports the document covering means in the vicinity of both ends on any side of the document covering means.

4. A the document pressing device as claimed in claim 1 further comprising transferring means for transferring the sliding movement of the adjusting means to the holding means.

5. A document pressing device as claimed in claim 4, wherein the transferring means includes:

first conversion means for changing the sliding movement of the adjusting means to rotation movement;

link means for transferring the rotation movement of the first conversion means toward the holding means; and second conversion means for changing the rotation movement of the first conversion means transferred by the link means to the sliding movement of the holding means.

6. A document pressing device as claimed in claim 5, wherein the link means comprises a combination of a plurality of gears which are intervened between the first conversion means and the second conversion means and transfer the rotation movement of the first conversion means to the second conversion means.

7. A document pressing device as claimed in claim 5, wherein the link means comprises a wire member which is put around the first conversion means and the second conversion means to transfer the rotation movement of the first conversion means to the second conversion means.

8. A document pressing device, comprising:

a document table disposed on a main body to support a document;

a document cover which covers the document table to press the document against the document table;

an adjusting hinge configured to support an opening/closing fulcrum of the document cover and being slidable in a thickness direction of the document according to the thickness of the document supported by the document table;

a holding member which can hold an opening and closing side of the document cover to slide in the thickness direction of the document in synchronization with the sliding movement of the adjusting hinge;

a hook disposed on the opening and closing side of the document cover to engage with the holding member to give the document cover a pressing force to press the document against the document table; and a release member to release the engagement of the hook from the holding member.

9. A document pressing device as claimed in claim 8, wherein the holding member slides in the thickness direction of the document on the side opposed to the side where the adjusting hinge is disposed in the vicinity of the document table, and the hook is engaged with the holding member on the side opposite to the side supported by the adjusting hinge of the document cover.

10. A document pressing device as claimed in claim 8, wherein the adjusting hinge supports the document cover in the vicinity of both ends of any side of the document cover.

11. A document pressing device according to claim 8 further comprising:

a transferring member for transferring the sliding movement of the adjusting hinge to the holding member.

12. A document pressing device as claimed in claim 11, wherein the transferring member includes:

a first gear to change the sliding movement of the adjusting hinge to a rotation movement;

a link member to transfer the rotation movement of the first gear toward the holding member;

and a second gear to change the rotation movement of the first gear transferred by the link member to the sliding movement of the holding member.

13. A document pressing device as claimed in claim 12, wherein the link member comprises a combination of a plurality of gears which are disposed between the first gear and the second gear and transfer the rotation movement of the first gear to the second gear.

14. A document pressing device as claimed in claim 12, wherein the link member comprises a wire member which is put around the first gear and the second gear and transfers the rotation movement of the first gear to the second gear.

15. A document pressing method for pressing a document against a document table by covering the document placed on the document table mounted on a main body by a document cover, comprising the steps of:

an adjusting step to slide an opening and closing fulcrum of the document cover in the thickness direction of the document according to a thickness of the document supported by the document table and slide a holding member for holding an opening and closing side of the document cover in the thickness direction of the document in synchronization with the sliding movement of the opening and closing fulcrum;

an engaging step to engage a hook fitted to the document cover with the holding member to press the document against the document table by the document cover; and a releasing step to release the engagement of the hook from the holding member.

16. A document pressing method as claimed in claim 15, wherein the engaging step is performed in synchronization with the operation to cover the document table with the document cover.

* * * * *